United States Patent [19]

Rossmann et al.

[11] 4,168,182

[45] Sep. 18, 1979

[54] METHOD OF PRODUCING SHAPED METALLIC PARTS

[75] Inventors: Axel Rossmann, Karlsfeld; Siegfried Helm, Petershausen; Peter Leven, Allershausen, all of Fed. Rep. of Germany

[73] Assignees: Motoren- und Turbinen-Union Munchen GmbH; Maschinenfabrik Augsburg-Nurnberg Aktiengesellschaft, both of Munich, Fed. Rep. of Germany

[21] Appl. No.: 917,761

[22] Filed: Jun. 21, 1978

Related U.S. Application Data

[63] Continuation-in-part of Ser. No. 740,900, Nov. 11, 1976, abandoned.

[30] Foreign Application Priority Data

Nov. 11, 1975 [DE] Fed. Rep. of Germany ..... 2550858

[51] Int. Cl.[2] ..... B22D 27/20; C22F 1/00

[52] U.S. Cl. ..... 148/3; 148/4; 148/13.1; 148/32; 148/127; 164/61

[58] Field of Search ..... 148/2–4, 148/32, 32.5, 127, 13.1; 164/423, 427, 429, 61, 87, 75, 89, 80; 75/171; 264/176; 427/383 C

[56] References Cited

U.S. PATENT DOCUMENTS

| | | | |
|---|---|---|---|
| 2,899,338 | 8/1959 | Goetzel et al. | 416/241 |
| 3,008,855 | 11/1961 | Swenson | 75/171 |
| 3,113,376 | 12/1963 | Pflumm et al. | 75/135 |
| 3,130,089 | 4/1964 | Mellinger | 148/13.1 |
| 3,248,764 | 5/1966 | Chandley | 75/171 |
| 3,283,377 | 11/1966 | Chandley | 75/171 |
| 3,529,958 | 9/1970 | Buehler | 75/135 |
| 3,592,628 | 7/1971 | Wuensches | 75/135 |
| 3,699,623 | 10/1972 | Kreider | 416/241 |
| 3,741,821 | 6/1973 | Athey et al. | 148/39 |
| 3,758,347 | 9/1973 | Stalker | 148/4 |
| 3,848,307 | 11/1974 | Kydd | 416/241 |

FOREIGN PATENT DOCUMENTS

| | | | |
|---|---|---|---|
| 2550858 | 5/1977 | Fed. Rep. of Germany | 164/61 |

OTHER PUBLICATIONS

Engineering, Oct. 1974, pp. 816–819.
Proceedings Third Space Processing Symposium—Skylab Results, vol. II, Apr. 30–May 1, 1974, NASA, Jun. 1974, pp. 939–945.
Engineering, Nov. 1973, pp. 810–813.
J. Vac. Sic. Technology, vol. 11, No. 6, Nov./Dec. 1974, pp. 1114–1116 & 1119.
J. Electrochem. Soc., Feb. 1975, pp. 276–283.

*Primary Examiner*—L. Dewayne Rutledge
*Assistant Examiner*—Peter K. Skiff
*Attorney, Agent, or Firm*—Alan H. Levine

[57] ABSTRACT

A shaped metal base component is formed, such as by casting or forging. The component is then thinly coated with a material, such as a ceramic material, having a higher melting point than the material of the shaped component. The coated component is then heated under zero gravity conditions up to a temperature which is below the melting point of the coating, but which is high enough to soften the component, the coating maintaining the shape of the component during the heating step. After completion of the heating step, the coated component is cooled under zero gravity conditions. The forming and coating of the component take place on earth, and the steps of heating and cooling the coated component are performed in space. After cooling the coated component, the coating is either stripped off the component or left on the component to form an integral part of the shaped body.

23 Claims, No Drawings

METHOD OF PRODUCING SHAPED METALLIC PARTS

This application is a continuation-in-part of Ser. No. 740,900 filed Nov. 11, 1976, abandoned.

This invention relates to a method of producing shaped metal base components, and more particularly to such a method including the steps of forming the metal base component and subjecting the component to heat after it is formed.

It is known that the quality of metal base components can be improved after production by a subsequent heat treatment. Although it is desirable to heat the components to a temperature which is above the solidus line of the material of which the component is made, the upper limit of the range of temperatures at which the heat treatment of metal base components has been carried out is about 50°-20° C. below the solidus line of the material of which the component is made. If the components were heated to a temperature which is above the solidus line of the material of which the component is made, the material of the component would soften and deformation of the component would occur. Such a deformation of the component after production is undesirable.

An object of the present invention is, therefore, to provide an improved method of producing a shaped body, the method including the step of subjecting the metal base component to heat so as to increase its temperature to a value which is above the solidus line of the material of which the component is made, while at the same time avoiding the tendency of the component to be deformed due to softening of the material of which the component is made.

This objective is achieved, according to the invention, by providing the metal base component, after it is formed by a manufacturing process which is known per se, over the whole of its surface with a shaped-maintaining, relatively thin coating of a material with a higher melting point than that of the material of which the component is made. Thereafter, the coated component is heated under zone gravity conditions to a temperature which is below the melting temperature of the coating material, but which is high enough to soften the component. The coated component is then cooled under zero gravity conditions to a temperature at which the component is in the solid state.

Depending upon the use to which the shaped body made by the method of the invention will be put, as well as the type of coating selected, the coating may either be stripped off the component after completion of the cooling step, or it may be left on the surface of the component to form an integral part of the finished body.

Preferably the coating material is non-reactive, so that no reaction takes place between the coating material and the material of which the component is made when the step of heating the coated component is carried out. If the coated component were heated under conditions wherein it is subjected to gravity, and at a temperature which softens or melts the material of which the component is made, preservation of the shape of the molten or semi-plastic component encased in a relatively thin coating would not be possible. If, however, as is provided for in the method according to the invention, the effects of gravity are avoided and the relatively weak forces still present, such as surface tension, are absorbed by the shape-maintaining, higher-melting-point surface coating, it is possible to heat the component so as to melt or soften the material of which the component is made without altering the shape of the component.

Preferably the step of forming the component and the step of coating its surface are carried out under conditions wherein gravity is present, e.g., on earth, and the coated component is then sent into space where the steps of heating and cooling the coated component are carried out. When the step of cooling the coated component is completed the coated component is transported back to earth.

The steps of heating and cooling the coated component may be performed in a space station orbiting the earth, and the coated component may be heated by use of high energy radiation, such as a laser or electron beam, or by electric current heating means. The energy required for carrying out the step of heating the coated component may be solar energy obtained by means of solar energy collectors and stored in batteries. Alternatively, the solar energy can be used directly by means of beam concentrating mirrors.

An essential feature of the process according to the invention is the application of the relatively thin surface coating to the previously-made component, the material of the coating having a higher melting point than that of the material of the component. A suitable coating material is a ceramic material. Metals with high melting points and oxide layers can also be employed to produce the surface coating. A suitable oxide layer consists of an aluminum oxide.

In certain cases it may also be expedient if the component is given a combined surface coating of a ceramic material and an intermetallic phase.

The thin surface coating, which is preferably between 5 and 100 μm thick, permits greater cooling gradients and increased diffusion, e.g., with gases. The application of the surface coatings to be used can be carried out in various ways, for example, by electro plating, by spraying, by oxidation, by separation from the gas phase, or by some other suitable process. The choice of the surface coating to be used in each case not only depends on the need for shape preservation but in particular on the following considerations:

(a) permeability by solids and/or gases;
(b) capability of diffusion;
(c) temperature stability;
(d) toughness;
(e) reactiveness with particular media;
(f) thermal conductivity; and
(g) heat radiation.

In a preferred embodiment of the invention the component is first built up layer-by-layer, preferably by electrodeposition, from metal alloy constituents. Such a component may be a turbine blade and the metal alloy constituents may be applied in layers of 1/10 mm thickness until the total thickness of the blade in the range of 1 mm or a few mm is obtained. Such an alloy may be a combination consisting mainly of chromium (approximately 75%), iron, and additions such as hafnium or rare earths.

The alloy used for the manufacturing of the component may solidify according to the eutectic type reaction in which two primary phases freeze simultaneously from a multi-component system. Preferably the alloy is solidified directionally to obtain a unidirectional structure.

The component may be formed by any other known manufacturing process such as casting or forging.

Another preferred embodiment of the invention, for the production of shaped bodies with optimum grain size distribution and orientation, involves the surface-coated component being subjected to heat under zero gravity conditions in such a manner that, by means of an appropriate temperature distribution and/or temperature gradients during the solidification phase and/or during the high-temperature annealing, it acquires optimum grain sizes in various of its zones. By heating a turbine blade in such a manner, it is possible to obtain in the airfoil part of the blade a coarse grain, for better creep characteristics and in the blade root a fine grain for more ductile behavior. Thus, in general, the invention contemplates that at least a closed geometric part of a coated component, such as the airfoil part of a turbine blade, is heated throughout to soften it.

The shaped bodies can have a relatively complicated configuration, e.g., turbine blades with interior cooling channels and air outlets in the walls. After such a turbine blade is formed, the outer surface of the blade and the walls defining the interior cooling channels and air outlets are coated with the shape maintaining coating. After coating the turbine blade, it is heated and cooled under zero gravity conditions, the shape of the cooling channels and air outlets being maintained by the coating while the material of the turbine blade is in the molten or semi-plastic state.

It is also possible to build up the component layer-by-layer by spraying metallic powder and particles capable of producing a dispersion-strengthening effect. The particles are not melted or softened during the step of heating the coated component, and are distributed uniformly in the component after its solidification. Examples of particles having a dispersion-strengthening effect are $ThO_2$ particles dispersed in a nickel alloy and $Al_2O_3$ particles dispersed in a chromium alloy. Alternatively the particles consist of a rare earth metal oxide and are dispersed in a nickel alloy.

A further way of forming the component consists in sintering metallic powder together with particles capable of producing a dispersion-strengthening effect. The metallic powder and the particles may be sintered together by a known hot-isostatic pressing process. Such a process is expedient, in the production of components of relatively complicated shape such as cooled turbine blades.

The component may be formed by joining mating parts. After joining these parts the component is coated and heated after coating under zero gravity conditions to melt the joint between the parts.

An important application of the method covered by the invention is the production of components used in the manufacture of gas turbines, in particular the production of turbine wheels and/or turbine blades. However, the workpiece can have an unlimited number of shapes, since the method is applicable to any shaped metallic part. The same materials used to form metal or metal base parts by conventional methods may be used according to the present invention. Furthermore the material used to coat the part may be of a kind conventionally used for enclosing metal parts to increase their heat resistance. Times and temperatures used for heat treatment are either the same as those used conventionally to heat treat a part of a particular metal, or would certainly be easily determined by anyone skilled in the art, so as to achieve well known improvements in the metal part which are brought about by heat treatment.

The essence of the present invention involves the combination of the following features: first, the formed metal base part is provided with a thin coating of a material having a higher melting point than the metal of the part and which is capable of maintaining the shape of the part even if the part is melted during the heat treatment; second heating the coated metal part under zero gravity conditions at a temperature below the melting temperature of the coating material but high enough to at least soften the part or even melt it; and third cooling the part under zero gravity conditions.

The invention has been shown and described in preferred form only, and by way of example,and many variations may be made in the invention which will still be comprised within its spirit. It is understood, therefore, that the invention is not limited to any specific form or embodiment except insofar as such limitations are included in the appended claims.

What is claimed is:

1. A method of producing a shaped metallic part, comprising the steps of:

(a) forming a component consisting essentially of a metal or a metal base material, (b) providing the component with a thin coating of a material having a higher melting point than the material of which the component is made, the coating being capable of maintaining the shape of the component even if the latter is heated to a molten state under zero gravity conditions, (c) heating the coated component under zero gravity conditions to a temperature which is below the melting temperature of the coating material, but which is high enough to soften at least a closed geometric part of the coated component whereby the coating maintains the shape of the component throughout, and (d) cooling the coated component under zero gravity conditions to a temperature at which the component is in the solid state.

2. A method as defined in claim 1 wherein the component is formed and coated on earth, and including the step of sending the coated component into space, the steps of heating and cooling the coated component being performed while it is in space.

3. A method as defined in claim 1 wherein the coating is about 5 to 100 $\mu$m thick.

4. A method as defined in claim 1 wherein the temperature to which the coated component is heated is high enough to melt the component.

5. A method as defined in claim 1 wherein the coating material is a ceramic material.

6. A method as defined in claim 1 wherein the coating material is a refractory metal.

7. A method as defined in claim 5 wherein the ceramic material is an oxide.

8. A method as defined in claim 7 wherein the oxide is a metal oxide.

9. A method as defined in claim 1 wherein the coating material is a combination of a ceramic material and an intermetallic phase.

10. A method as defined in claim 4 wherein the component is formed by building it up layer-by-layer of metal alloy constituents.

11. A method as defined in claim 10 wherein the layer-by-layer build up is produced by electrodeposition.

12. A method as defined in claim 1 wherein the coated component is heated and cooled selectively with an appropriate temperature distribution and temperature gradient to create different optimum grain sizes in selected portions of the component.

13. A method as defined in claim 1 wherein the component is formed with an outer surface and walls defining cavities, and the outer surface and the walls defining the cavities are coated with the coating material.

14. A method as defined in claim 1 wherein the component consists of an alloy substantially solidifying according to the eutectic type reaction in which two primary phases freeze simultaneously from a multi-component system.

15. A method as defined in claim 14 wherein the alloy is solidified directionally to obtain a unidirectional structure.

16. A method as defined in claim 1 wherein the component is formed by sintering metallic powder together with particles capable of producing a dispersion strengthening effect, the temperature to which the coated component is heated being high enough to melt the sintered metallic powder, the particles being distributed uniformly in the component after its solidification.

17. A method as defined in claim 1 wherein the component is formed by building it up layer-by-layer formed by spraying metallic powder and particles capable of producing a dispersion strengthening effect, the temperature to which the component is heated being high enough to melt the sprayed metallic powder, the particles being distributed uniformly in the component after its solidification.

18. A method as defined in claim 16 wherein the metallic powder and the particles are sintered together by hot-isostatic pressing.

19. A method as defined in claim 1 wherein the component is formed by joining a plurality of parts, and the so-formed component is heated after coating to melt the joint between the parts.

20. A method as defined in claim 1 wherein the coating is an aluminum oxide.

21. A method as defined in claim 10 wherein the component is a chromium/iron alloy.

22. A method as defined in claim 17 wherein the metallic powder is a nickel alloy and the particles are $ThO_2$ or a rare earth metal oxide.

23. A method as defined in claim 17 wherein the component is a chromium alloy and the particles are $Al_2O_3$.

* * * * *